US007508343B1

(12) United States Patent
Maloratsky et al.

(10) Patent No.: US 7,508,343 B1
(45) Date of Patent: Mar. 24, 2009

(54) SWITCHED BEAM FORMING NETWORK FOR AN AMPLITUDE MONOPULSE DIRECTIONAL AND OMNIDIRECTIONAL ANTENNA

(75) Inventors: Leo G. Maloratsky, Indialantic, FL (US); Andrew M. Vesel, Indialantic, FL (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 168 days.

(21) Appl. No.: 11/527,355

(22) Filed: Sep. 26, 2006

(51) Int. Cl.
*H01Q 3/02* (2006.01)

(52) U.S. Cl. ..... 342/374

(58) Field of Classification Search ..... 342/373–374; 343/818–819
See application file for complete search history.

(56) References Cited

U.S. PATENT DOCUMENTS 5,191,349 A 3/1993 Dinsmore et al. ..... 343/751
5,610,617 A * 3/1997 Gans et al. ..... 342/373
2005/0168301 A1* 8/2005 Carson ..... 333/117

OTHER PUBLICATIONS

U.S. Appl. No. 11/527,353, "Aircraft Directional/Omnidirectional Antenna Arrangement" by Inventors Leo G. Maloratsky et al.

* cited by examiner

*Primary Examiner*—Thomas H Tarcza
*Assistant Examiner*—Nga X Nguyen

(57) ABSTRACT

A switched beam forming network is disclosed having an antenna array and an integral beam forming network configured to selectively provide directional and omnidirectional antenna radiation patterns. Four 90-degree hybrids are serially interconnected to form a 4×4 hybrid matrix. The hybrid matrix receives and transmits signals through antenna monopoles and is configured to selectively switch between directional and omnidirectional operation. At least four antenna terminals connect the hybrid matrix to the antenna monopoles. Four input/output ports connect the hybrid matrix to a transmit/receive network through connecting lines. A plurality of switches are selectively actuatable to form the beam forming network.

19 Claims, 7 Drawing Sheets

SWITCHED BEAM FORMING NETWORK FOR AN AMPLITUDE MONOPULSE DIRECTIONAL AND OMNIDIRECTIONAL ANTENNA

RELATED INVENTIONS

This application is related to and commonly owned U.S. application Ser. No. 11/527,353, filed Sep. 26, 2006, now U.S. Pat. No. 7,385,560, issued Jun. 10, 2008, titled "Aircraft Directional/Omnidirectional Antenna Arrangement," the subject matter of which is incorporated by reference herein in its entirety.

FIELD OF THE INVENTION

The invention relates to antenna systems, and more particularly, to systems formed with an array of antenna monopoles providing multiple modes of operation.

BACKGROUND OF THE INVENTION

Beam forming networks have a wide range of applications. In one application the network is used as a power divider/combiner for distributing radio frequency (RF) and/or microwave signals between one port of the network and a plurality of other ports connected to antenna monopoles.

The concept of an orthogonal beam forming network is well-known in the art as a Fourier matrix or a Butler matrix. FIG. 1 illustrates a known beam forming network 100 which includes four 90 degree hybrids 109, 110, 111, 112 connected in a 4×4 matrix as shown. The matrix has four inputs 105, 106, 107, 108, and four outputs 101, 102, 103, 104.

One application of this network is described in U.S. Pat. No. 5,191,349, "Apparatus and Method for an Amplitude Monopulse Directional Antenna," the disclosure of which is incorporated herein by reference in its entirety. FIG. 2 is an example of a beam forming network 200 used in a traffic alert and collision avoidance system (TCAS) as depicted in the '349 patent. Network 200 includes four 90 degree hybrids 109, 110, 111, 112 and four inputs 105, 106, 107, 108. Outputs 101, 102, 103, 104 to network 200 are connected to four monopoles A1, A2, A3, A4 of a directional antenna (not shown) through matching networks 205, 206, 207, 208. Using network 200, the antenna provides transmit radiation in a directional pattern and receives signals by comparing the amplitudes of the signals induced in the plurality of antenna monopoles. Such an antenna system is suitable for transmitting and receiving TCAS information using a directional antenna radiation pattern only. However, in some applications an antenna should be capable of alternately forming omnidirectional as well as directional antenna radiation patterns. In the current application, the same antenna also has to be used for Transponder and Universal Access Transceiver (UAT) systems with an omnidirectional antenna pattern during both transmit and receive modes. The conventional 4×4 hybrid matrix, connected to a transmit/receive block by four cables, cannot be used as an omnidirectional antenna without beam steering and phase calibration networks. These additional networks vary the phasing of the transmit signal to provide directional and omnidirectional antenna radiation patterns. The additional networks are required to form the omnidirectional antenna radiation pattern and to minimize phase differences, including antenna cable errors and errors relating to transmission pass differences between the channels. The known systems are therefore very complicated, costly, and are characterized by large sizes and extra weight.

It is therefore an object of the invention to provide a means for alternately forming omnidirectional and directional antenna radiation patterns in an antenna system.

It is another object of the invention to provide a means for alternately forming omnidirectional and directional antenna radiation patterns for a TCAS system, Transponder and UAT systems during transmit and receive modes.

It is still another object of the invention to provide a switched beam forming network without any additional beam steering and phase calibration networks.

A feature of the invention is a 4×4 hybrid matrix and a switching network that can form an omnidirectional antenna radiation pattern and a directional antenna radiation pattern for both transmit and receive modes.

An advantage of the invention is that no complicated beam steering and phase calibration networks are required to form directional and omnidirectional antenna radiation patterns.

SUMMARY OF THE INVENTION

The invention provides switched beam forming network having an antenna array and an integral beam forming network configured to selectively provide directional and omnidirectional antenna radiation patterns. Four 90-degree hybrids are serially interconnected to form a 4×4 hybrid matrix. The hybrid matrix receives and transmits signals through antenna monopoles and is configured to selectively switch between directional and omnidirectional operation. At least four antenna terminals connect the hybrid matrix to the antenna monopoles. Four input/output ports connect the hybrid matrix to a transmit/receive network through connecting lines. A plurality of switches are selectively activated to form the beam forming network.

The invention also provides a switched beam forming antenna having an antenna array and an integral beam forming network configured to selectively provide directional and omnidirectional antenna radiation patterns Four 90-degree hybrids are serially interconnected to form a 4×4 hybrid matrix. The hybrid matrix is operable to receive and transmit signals through antenna monopoles and configured to selectively switch between directional and omnidirectional operation. At least four antenna terminals connect the hybrid matrix to the antenna monopoles. Four input/output ports connect the hybrid matrix to a transmit/receive network through connecting lines. A plurality of switches are selectively actuatable to form the beam forming network. Four quarter wavelength transmission lines are electrically coupled between the four 90-degree hybrids.

The invention further provides a switched beam forming network including an antenna array and an integral beam forming network configured to selectively provide directional and omnidirectional antenna radiation patterns. Means are provided for connecting four 90-degree hybrids to form a 4×4 hybrid matrix, the hybrid matrix being operable to receive and transmit signals through antenna monopoles and configured to selectively switch between directional and omnidirectional operation. Means are provided for connecting at least four antenna terminals between the hybrid matrix and the antenna monopoles. Means are provided for providing input/output ports configured to connect the hybrid matrix to a transmit/receive network through connecting lines. Means are provided for selectively actuating the network to form directional and omnidirectional antenna radiation patterns.

DETAILED DESCRIPTION OF THE DRAWINGS

Figure 1:
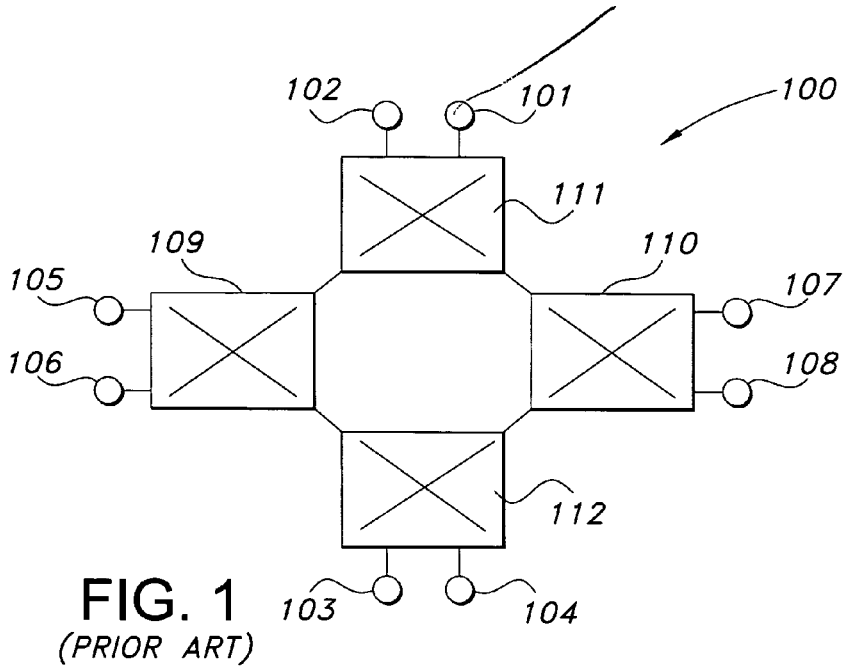
FIG. 1 (PRIOR ART)
FIG. 1 is a high-level schematic representation of a known hybrid matrix.
Figure 2:
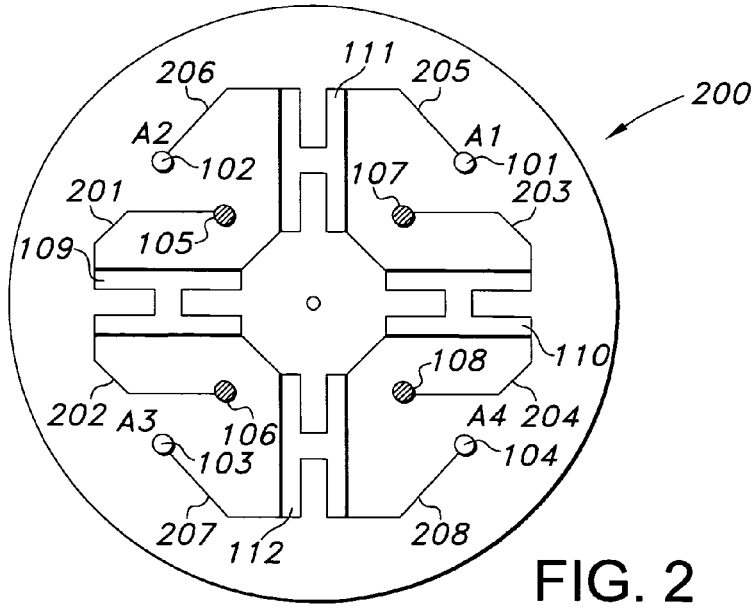
FIG. 2 (PRIOR ART)
FIG. 2 is a schematic of a known beam forming network used in a directional antenna.

The invention overcomes the limitations of known antenna systems by using a combination of a 4×4 hybrid matrix and a switching network to provide an alternately forming directional and omnidirectional antenna radiation patterns during transmit and receive modes. In contrast to conventional monopole configurations, no complicated architecture is required. Furthermore, no special beam steering and phase calibration networks are necessary.

According to one aspect a switched beam forming network includes an antenna array and an integral beam forming network that alternately forms directional and omnidirectional antenna radiation patterns for a traffic surveillance antenna in response to an external command.

According to another aspect of the invention, an input/output of the 90-degree hybrid of a second hybrid pair is electrically coupled to an antenna monopole through a 180-degree phase shifter, which in a preferred embodiment is a switched-line phase shifter.

According to another aspect of the invention, a single-pole single-throw switch is disposed between the input/output of the 90-degree hybrid of the second hybrid pair and the antenna monopole, where the 180-degree switched-line phase shifter is controlled to provide an amplitude calibration process over the four receiver channels.

According to another aspect of the invention, shunt grounded resistors electrically coupled to input/output terminals are used to control correct connection of four connecting lines to the input/output terminals.

According to another aspect of the invention, the two 90-degree hybrids of a first pair are electrically coupled to the two 90-degree hybrids of the second pair by four quarter wavelength transmission lines.

According to another aspect of the invention, the four additional transmission lines are electrically coupled to each other in the common junction and also electrically coupled to the four junctions between two said first 90 degree hybrids and four said quarter wavelength transmission lines, and said common junction being electrically coupled to the one input/output of the switched beam forming network through a bypass transmission line and a single-pole single-throw switch.

According to still another aspect of the invention, the four terminals of the first two 90-degree hybrids are electrically coupled to the four inputs/outputs of the beam forming network through four single-pole single-throw switches and four transmission lines.

According to another aspect of the invention, one input/output of the switched beam forming network is electrically coupled to a fifth antenna monopole through transmission lines and a single-pole single-throw switch.

According to yet another aspect of the invention, one input/output of the switched beam forming network is electrically coupled to the fifth antenna monopole through a transmission line and two single-pole single-throw switch.

The object of the invention is to provide directional and omnidirectional antenna operation in both receive and transmit modes. For the omnidirectional mode, the signal processing is performed in the switched network, so that additional complicated, costly and potentially lossy beam steering and phase calibration networks are not necessary.

Figure 3:
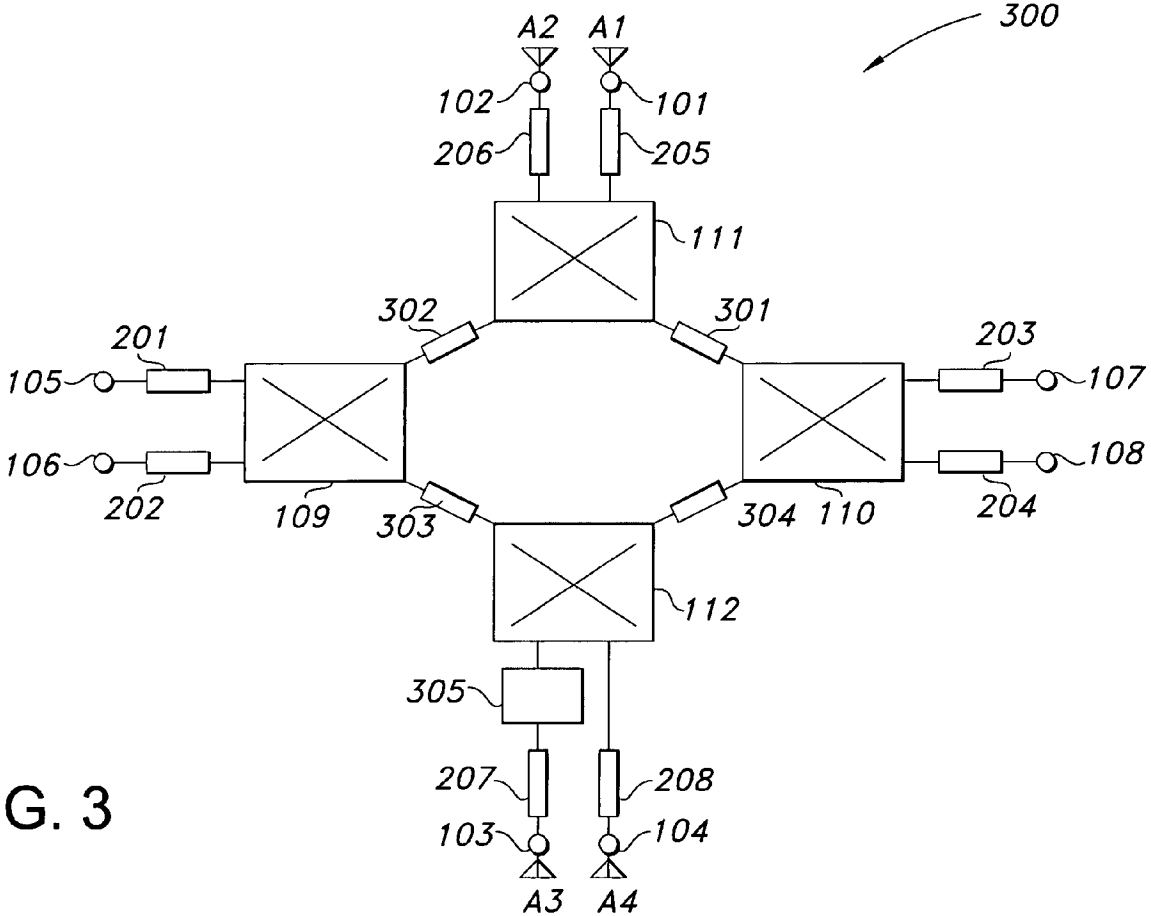
FIG. 3 is a high-level schematic representation according to the invention.

Turning now to the Figures, in which common reference numbers represent similar components, FIG. 3 depicts a switched beam forming network 300 according to the invention. Input/output ports 105, 106, 107, 108 are electrically coupled to a first set of 90-degree hybrids 109 and 110 through transmission lines 201, 202, 203, and 204, respectively. First 90-degree hybrids 109, 110 are electrically coupled to a second set of 90-degree hybrids 111, 112 through quarter-wavelength transmission lines 301, 302, 303 and 304. 90-degree hybrid 111 is electrically coupled to antenna terminals 101, 102, through impedance matching elements 205, 206, respectively. 90-degree hybrid 112 is electrically coupled to antenna terminals 103, 104 through impedance matching elements 207, 208, respectively. Two closely spaced pairs of orthogonally positioned antenna monopoles A1, A2, A3, A4 are used as direction finding antennae to determine the relative bearing of a signal source that is distant from the antenna array. During a transmit mode only one input/output port 105, 106, 107 or 108 is activated. During a receive mode incoming signals are processed inside the switched beam forming network to produce four output terminal signals such that each electrical signal represents a unique quadrant of the polar coordinate system.

A phase shifter, which in a preferred embodiment is a switched-line phase shifter 305, is disposed between one antenna terminal 103 and a port of one of the 90-degree hybrids 112. When a directional antenna radiation pattern is desired, switched-line phase shifter 305 is in the zero-degree position. When an omnidirectional antenna radiation pattern is desired, switched-line phase shifter 305 is controlled to be in the 180-degree position. All 90-degree hybrids 109-112, transmission lines 201-204 and 301-304, and impedance-matching elements 205-208 are preferably fabricated or made of conventional coaxial cables or lines, microstrip lines, striplines, or the like.

It is possible to match impedance between antenna monopoles A1, A2, A3, A4 and the 4×4 hybrid matrix without impedance matching elements 205, 206, 207, 208 by modifying the 90-degree hybrids 109, 110, 111, 112 with unique impedance transmission line values.

When a directional antenna pattern is desired, for example during a 1030 MHz TCAS transmit mode, switched phase shifter 305 provides zero phase shift, and the transmit signal passes alternately to only one input/output port 105, 106, 107 or 108. When input/output port 105 is activated, the signal phases of antenna terminals 101, 102, 103, 104 are 0, 270, 0, and 90 degrees, respectively, and the direction of the antenna radiation pattern is on the left position, or in the left quadrant. When input/output port 106 is activated, the signal phases of input/output ports 101-104 are 90, 0, 270, and 0 degrees, respectively, and the direction of the antenna radiation pattern is oriented toward the front position. When input/output port 107 is activated, the signal phases of input/output ports 101-104 are 270, 0, 90, and 0 degrees, respectivley, and the direction of the antenna radiation pattern is oriented toward the aft position. When input/output port 108 is activated, the signal phases are 0, 90, 0, and 270 degrees, respectively, and the direction of the antenna radiation pattern is oriented to the right.

For the omnidirectional antenna mode, only one input/output port 106 or 107 should be activated, and a 180-degree phase shift should be provided by switched-line phase shifter 305 as previously discussed. In this case the progressive 90-degree phase shift at the antenna terminals is realized and therefore the antenna radiation pattern is omnidirectional.

Figure 4:
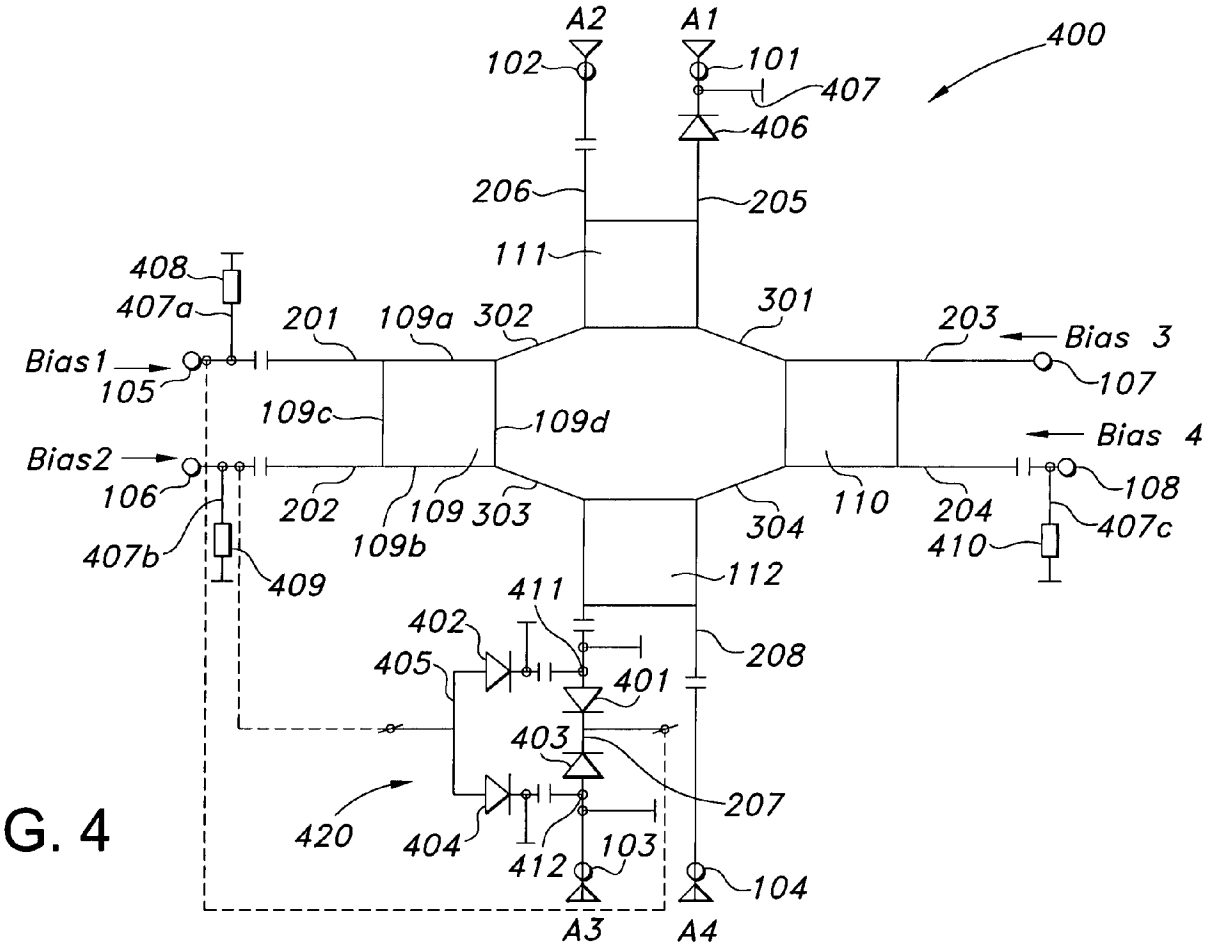
FIG. 4 is a more detailed schematic representation of the invention.

FIG. 4 illustrates a schematic representation of another embodiment of the invention including a switched beam forming network 400 using four two-branch 90-degree hybrids 109, 110, 111, 112. Transmission lines 201-204 and 301-304 are provided as described in previous embodiments. Network 400 also includes a 180-degree switched-line phase shifter 420 and a single-pole single-throw PIN diode switch 406. 180-degree switched-line phase shifter 420 includes two single-pole double-throw switches with PIN diodes 401, 402, 403, 404 that provide a 180-degree differential phase shift between line 405 and bypass line 207. All diodes 401, 402, 403, 404 and 406 are activated by an external command. For example, PIN diodes 401, 403 are activated by a signal BIAS1 entering through input/output port 105. PIN diodes 402, 404 are activated by a signal BIAS2 entering through input/output port 106. PIN diode 406 is activated by a signal BIAS3 entering through input/output port 107. During the directional antenna mode, PIN diodes 401 and 403 are activated by signal BIAS1 to be in the "on" position, PIN diodes 402 and 404 are in the "off" position, and PIN diode 406 is activated by signal BIAS3 to be in the "on" position. In the omnidirectional antenna mode, PIN diodes 401, 403 are in the "off" position, PIN diodes 402, 404 are activated by signal BIAS2 to be in the "on" position, and PIN diode 406 is activated by signal BIAS3 to be in the "on" position.

During the receive mode the incoming signals are processed inside the switched beam forming network to produce four signals at input/output ports 105, 106, 107, 108 such that each electrical signal represents a unique quadrant of the polar coordinate system. By comparing the relative signal intensities of each electrical signal, the relative position of a signal source, such as an aircraft, can be determined.

There is a difference in losses between the input/output ports, between the four antenna cables, and between the four receiver channels. The lengths of the cables are not critical because only signal magnitudes are used for determining bearing of a received signal. Phase relationships are not used for this calculation.

To minimize the aircraft position error the four receiver channels should provide equal loss or gain. A simple amplitude calibration can be realized by using single-pole single-throw PIN diode switch 406, which as previously discussed is activated by a signal BIAS3. The amplitude calibration process includes several steps. During each step, input/output ports 105, 106, 107, 108 are alternately activated by an RF calibration signal, and diodes 401, 402, 403, 404 and 406 are in the "off" position. As a result, the RF calibration signal reflects from the switched-line phase shifter 420 and from single-pole single-throw switch 406, and appears at input/output ports 108, 107, 106 or 105, respectively. Another method of calibrating the amplitude is to use the existing coupling between the antenna monopoles A1, A2, A3, A4. In this case it is not necessary to use the single-pole single-throw switch 406. To pass the calibration signal through antenna monopoles A1, A2, A3, A4, PIN diodes 401, 403 should be activated to be in the "on" position and PIN diodes 402, 404 should be in the "off" position.

The self-test network provides the correct connection between input/output ports 105, 106, 107, 108 and the cables (not shown) connecting the antenna to the receiver/transmitter (not shown). The self-test network is realized by three unique shunt resistors 408, 409, 410 that are connected respectively to input/output ports 105, 106 and 108 through quarter-wavelength high impedance transmission lines 407*a*, 407*b*, 407*c*. Shunt resistors 408, 409, 410 are activated by external signals BIAS1, BIAS2, and BIAS4, respectively. The shunt resistors do not affect the RF operation of the switched beam forming network.

As depicted, switched beam forming network 400 includes diodes at two input/output ports 101 and 103, while the other two input/output ports 102 and 104 have no diodes associated therewith. Therefore, the beam forming network loss at the four input/output ports are different. For a satisfactory antenna radiation pattern in both directional and omnidirectional operations or modes the signal amplitudes of all four input/output ports should be equal. This condition is realized by modifying the 90-degree hybrids. Hybrids 109, 110 should be used with unequal power division corresponding to the ratio between signals at antenna terminals 103 and 101, or corresponding to the loss difference between switched-line phase shifter 420 and single-pole single-throw PIN diode switch 406. Also, hybrid 112 should be used with unequal power division corresponding to the ratio between signals at antenna terminals 103, 104, or corresponding to the loss difference between switched-line phase shifter 420 and transmission line 208. If diode 406 is used, hybrid 111 should be used with unequal power division corresponding to the ratio between signals at input/output ports 101, 102, or corresponding to the loss difference between single-pole single-throw PIN diode switch 406 and transmission line 206.

For example, if the switched-line 180-degree phase shifter 420 provides 0.8 dB loss, and the single-pole single-throw PIN diode switch 406 provides 0.4 dB, the power ratio for hybrid 109, 110, and 111 should be 1.1:1, and the power ratio for hybrid 112 should be 1.2:1. To realize unequal power division the hybrid impedances (or admittances) should be different from impedances (or admittances) of the equal power dividers.

For a two-branch divider such as hybrid 109, the normalized admittance $Y_1$ of the quarter-wavelength branch lines 109*a* and 109*b*, and the normalized admittance $Y_2$ of the quarter-wavelength connection lines 109*c* and 109*d*, are a function of the power ratio as follows:

$$Y_1 = \sqrt{\frac{1}{m}} \quad \text{(Equation 1)}$$

$$Y_2 = \sqrt{\frac{m+1}{m}} \quad \text{(Equation 2)}$$

From these equations the line normalized admittances for hybrids 109, 110 and 111 should be $Y_1$=0.95, $Y_2$=1.38. For hybrid 112 the normalized admittances should be $Y_1$=0.91, $Y_2$=1.354.

Figure 6:
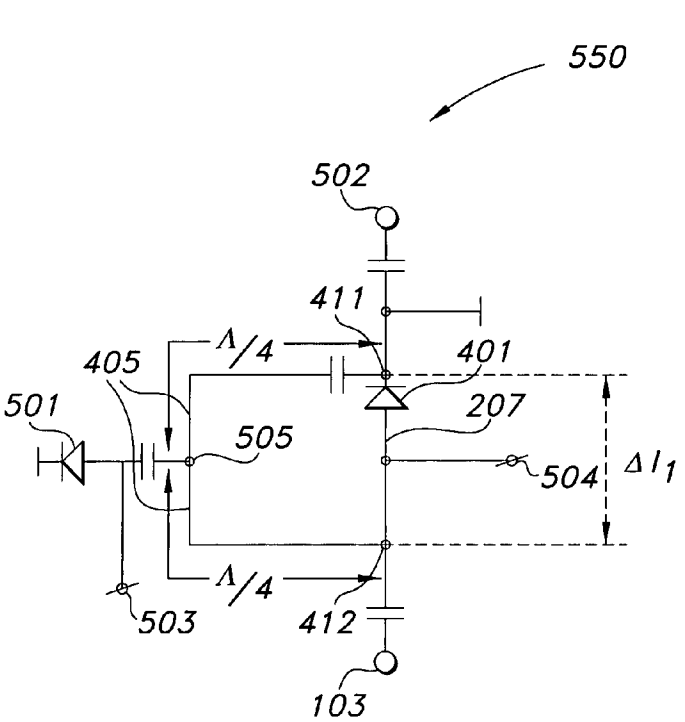
FIG. 6 is a schematic diagram of a switched-line 180-degree phase shifter with two diodes.
Figure 5:
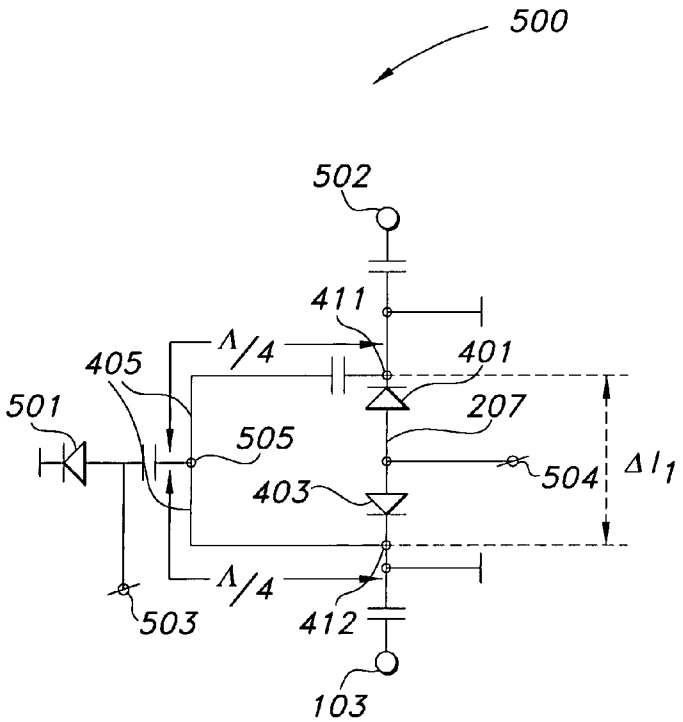
FIG. 5 is a schematic diagram of a switched-line 180-degree phase shifter with three diodes.

FIGS. 5 and 6 illustrate two other 180-degree switched-line phase shifters 500, 550. In FIG. 5, 180-degree switched-line phase shifter 500 includes an RF input 502 and an RF output 103. Three PIN diodes 401, 403 and 501 provide a 180-degree differential phase shift between line 405 and a bypass line 207. Diode 501 is activated from bias port 503, and diodes 401, 403 are activated from bias port 504. For a directional antenna mode, diodes 401, 403 and 501 are activated in the "on" position. For an omnidirectional antenna mode, diodes 401, 403, 501 are in the "off" position. The segment of line 405 between junction 505 and junction 411 has a length equal to one quarter guide wavelength $\Lambda/4$. The other segment of line 405, i.e., between junction 505 and junction 412, is also equal to one quarter guide wavelength $\Lambda/4$. During the directional antenna mode, these quarter guide wavelength lines transform the short circuit of diode 501 into an open circuit at the junctions 411 and 412, and an RF signal passes through bypass line 207 with length $\Delta l_1$. During the omnidirectional antenna mode, series diodes 401, 403 and shunt diode 501 are opened, and an RF signal passes through line 405 with a total of one half guide wavelength.

FIG. 6 illustrates another embodiment of a 180-degree switched-line phase shifter 550 that includes an RF input 502 and an RF output 103. Two PIN diodes 401 and 501 provide a 180-degree differential phase shift between line 405 and bypass line 207. For the directional antenna mode, diodes 401 and 501 are controlled through bias ports 504 and 503, respectively, to be in the "on" position. For the omnidirectional antenna mode, the diodes 401 and 501 are in the "off" position. The segment of line 405 between junction 505 and junction 411 has a length equal to one quarter guide wavelength. The other segment of line 405, between junction 505 and junction 412, is also equal to one quarter guide wavelength. Therefore, during the directional antenna mode, these quarter guide wavelength lines transform the short circuit of diode 501 into an open circuit at junctions 411 and 412, and an RF signal passes through bypass line 207 with length $\Delta l_1$. During the omnidirectional antenna mode, diode 401 and shunt diode 501 are opened, and an RF signal passes through line 405 with the one-half guide wavelength providing a 180-degree phase shift.

In both circuits shown in FIGS. 5 and 6, the length $\Delta l_1$ of bypass line 207 should be minimized to provide differential 180-degree phase shift in line 405 relative to bypass line 207. To realize this condition, for example, bypass line 207 should have no underlying ground. This increases the guide wavelength in bypass line 207, and therefore decreases the bypass phase shift.

Figure 7:
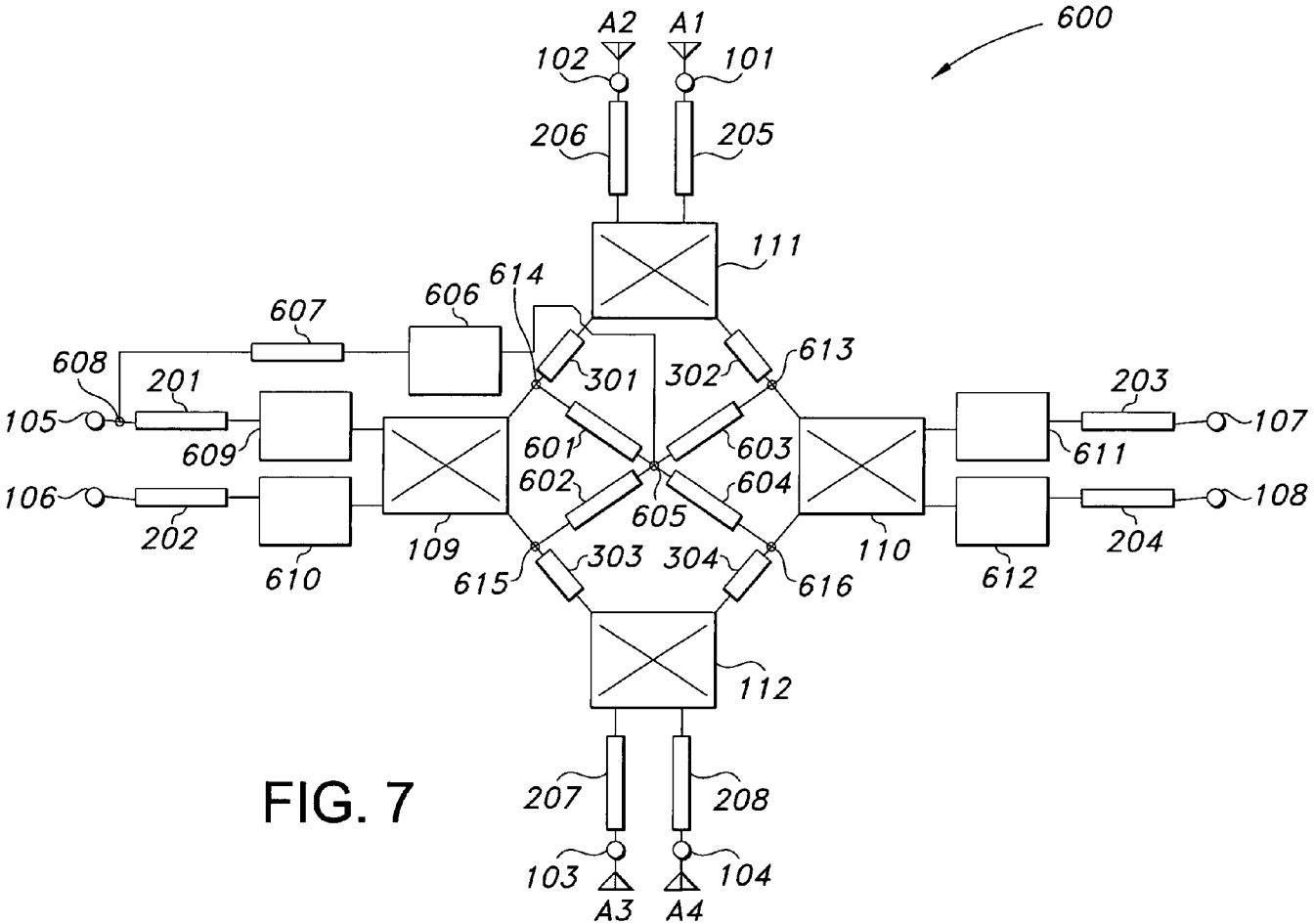
FIG. 7 is a high-level schematic diagram of another embodiment of the invention.

FIG. 7 illustrates a high-level schematic representation of a switched beam forming network 600 according to another embodiment of the invention. The additional bypass network includes a single-pole single-throw bypass switch 606 electrically coupled to a junction 605 of four additional quarter-length transmission lines 601, 602, 603, 604. The additional transmission lines 601-604 are electrically coupled to four junctions 613, 614, 615, 616, respectively, between the 90-degree hybrids 109, 110 and connection lines 301, 302, 303, 304. Bypass switch 606 is electrically coupled to a common junction 608 of input 105 through a quarter-length transmission line 607. Single-pole single-throw switches 609, 610, 611, 612 are interposed along transmission lines 201, 202, 203, 204, respectively, between input/output ports 105, 106, 107, 108 and a first set of 90-degree hybrids 109, 110 as shown in FIG. 7. For the omnidirectional antenna mode when only one input/output port 105 is activated, network 600 provides equal power division between the inputs/output ports of a second set of 90-degree hybrids 111, 112 and between the four antenna terminals 101, 102, 103, 104. Single-pole single-throw switches 609, 610, 611, 612 are set at "off" and bypass switch 606 is set at "on". For the directional antenna mode, one of input switches 609-612 is set at "on", bypass switch 606 is set at "off", and only one of input/output ports 105-108 is activated according to the desired antenna directionality. In this case, quarter-length transmission lines 601-604 and 607 transform the short circuit of single-pole single-throw bypass circuit 606 into an open circuit at the junctions 613, 614, 615, 616, and 608, respectively.

Figure 8:
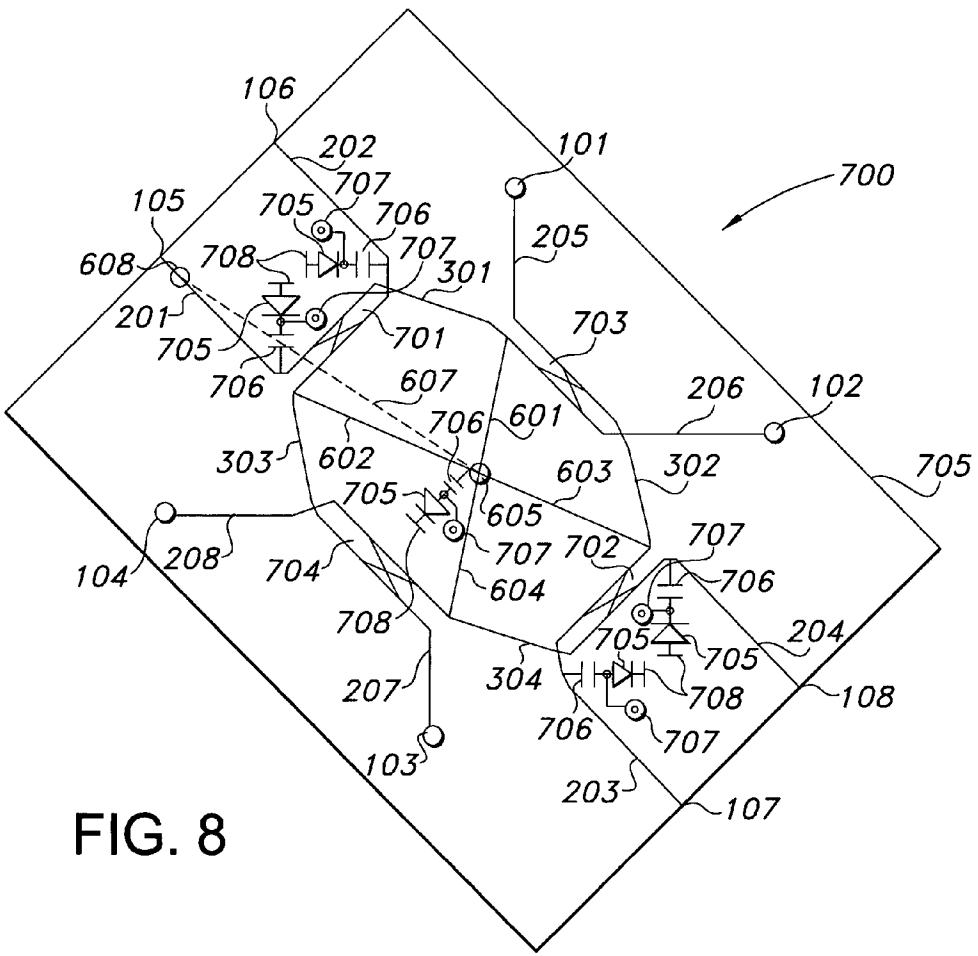
FIG. 8 is a schematic diagram of still another embodiment of the invention.

FIG. 8 illustrates another switched beam forming network 700, which is similar to the network shown in FIG. 7. Reference numbers 101-108, 201-208, 301-304 and 607-608 are as described in previous embodiments of the invention. Network 700 includes a four-way divider having four additional transmission lines 601, 602, 603, 604. Network 700 also includes 3 dB 90-degree coupled-line directional couplers 701, 702, 703, 704. The coupled-line 3 dB 90-degree directional couplers can be, for example, conventional Lange couplers or wireline coaxial hybrids. Reference numbers 705-708 refer to components of the switch for each switched phase shifter. Specifically, 705 is a diode, 706 is a DC-blocking capacitor, 707 is a drive where current is applied, and 708 is a ground.

Figure 9:
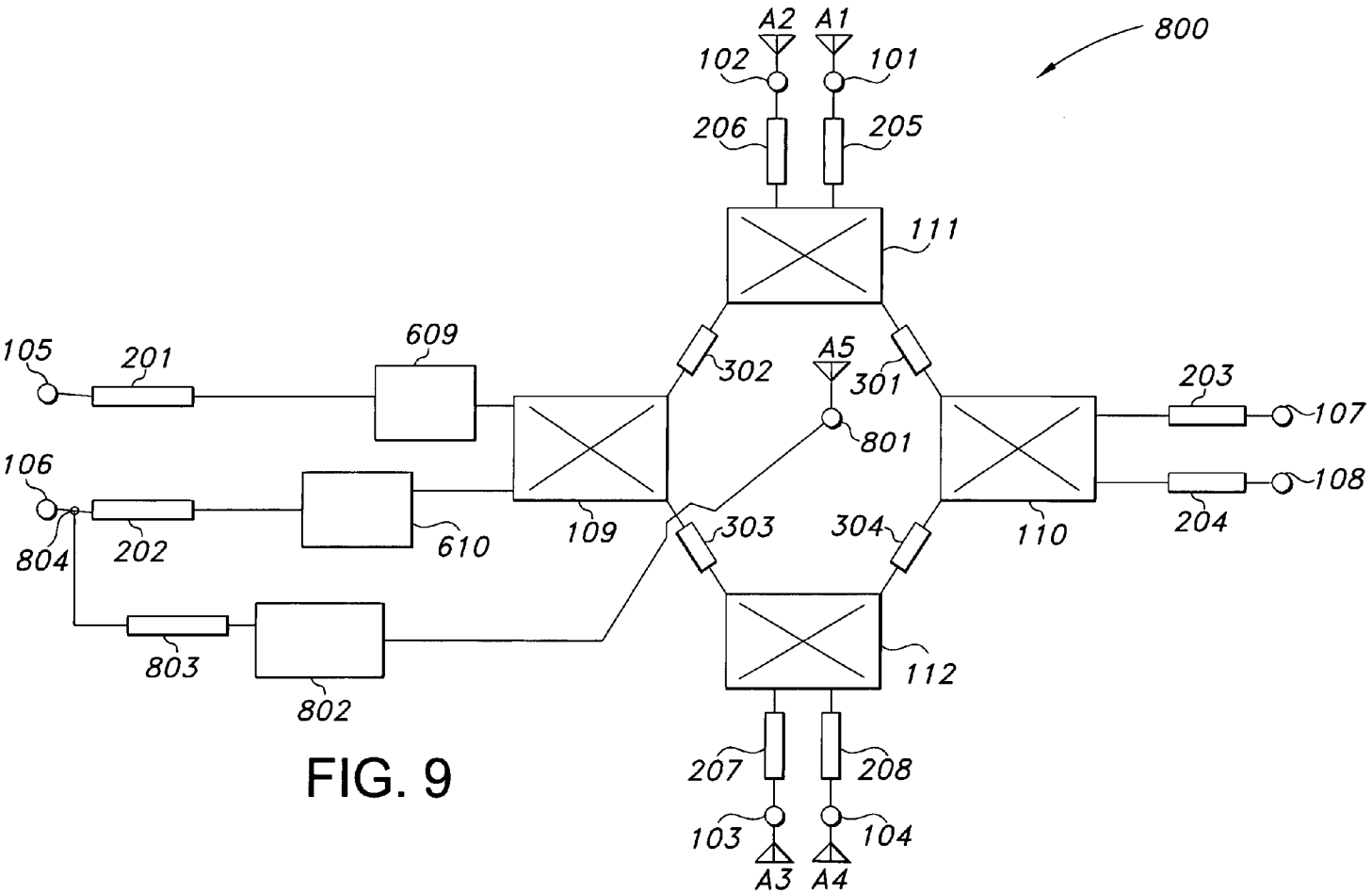
FIG. 9 is a schematic diagram of yet another embodiment of the invention.

FIG. 9 is a high-level schematic representation of a switched beam forming network 800 according to still another embodiment of the invention. Reference numbers A1-A4, 101-112, 201-208, 301-304, and 609-610 are as described in previous embodiments of the invention. In network 800, an omnidirectional monopole antenna A5 is electrically coupled to a fifth antenna terminal 801, which is electrically coupled to a common junction 804 through transmission line 803 and to a single-pole single-throw switch 802. Omnidirectional antenna A5 can provide an omnidirectional transmit mode for Transponder signals, Universal Access Transceiver (UAT) signals, and sometimes for Traffic Collision and Avoidance System (TCAS) signals. The quarter guide wavelength transmission line 803 supports a directional mode when single-pole single-throw switch 802 is "off". The quarter guide wavelength transmission line 202 supports an omnidirectional mode when single-pole single-throw switch 802 is "on" and single-pole single-throw switch is "off".

An advantage of the invention is that the combined 4×4 hybrid matrix and switching network requires no complicated architecture to transmit and receive in directional and omnidirectional modes.

Another advantage is that no special beam steering and phase calibration networks are necessary for selectively and alternatively forming directional and omnidirectional antenna radiation patterns in an antenna system. Elimination of the beam steering and phase calibration networks reduces size, weight, and manufacturing costs of the system as compared to known antenna systems.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A switched beam forming network comprising an antenna array and an integral beam forming network configured to selectively provide directional and omnidirectional antenna radiation patterns, wherein said integral beam forming network further includes:

four 90-degree hybrids being serially interconnected to form a 4×4 hybrid matrix, the hybrid matrix being operable to receive and transmit signals through antenna monopoles and configured to selectively switch between directional and omnidirectional operation;

at least four antenna terminals that connect the hybrid matrix to the antenna monopoles;

four input/output ports configured to connect the hybrid matrix to a transmit/receive network through connecting lines;

a plurality of switches that are selectively actuatable to form the beam forming network;

wherein a 180-degree phase shifter is electrically coupled between an input/output port associated with one of the 90-degree hybrids and a first one of the antenna terminals;

wherein the 180-degree phase shifter, switched on a first 180-degree phase position, provides a progressive 90-degree phase shift for the four antenna terminals and creates an omnidirectional antenna radiation pattern with activation of only one of the input/output ports; and wherein the 180-degree phase shifter, switched on a second bypass position, creates a directional antenna radiation pattern with alternate activation of the four input/output ports.

2. The switched beam forming network of claim 1, wherein one of the plurality of switches is electrically coupled between the input/output port of said one of the 90-degree hybrids and second one of the antenna terminals with diagonal location relative to said first one of the antenna terminals, to thereby provide an amplitude calibration network for four receivers coupled to four said inputs/output ports through four connecting lines.

3. The switched beam forming network of claim 2, wherein each of the 90-degree hybrids have unique line impedances that thereby provide unequal power division corresponding to loss of the 180-degree phase shifter, and wherein said one of the plurality of switches provides equal amplitude activation of said antenna monopoles.

4. The switched beam forming network of claim 2, wherein shunt grounded resistors are electrically coupled to the input/output ports of the 4×4 hybrid matrix to provide, together with said amplitude calibration network, a self test of proper connection between the connecting lines and the four input/output ports of the 4×4 hybrid matrix as well as test of antenna failure.

5. A switched beam forming network comprising an antenna array and an integral beam forming network configured to selectively provide directional and omnidirectional antenna radiation patterns, wherein said integral beam forming network further includes:

four 90-degree hybrids being serially interconnected to form a 4×4 hybrid matrix, the hybrid matrix being operable to receive and transmit signals through antenna monopoles and configured to selectively switch between directional and omnidirectional operation;

at least four antenna terminals that connect the hybrid matrix to the antenna monopoles;

four input/output ports configured to connect the hybrid matrix to a transmit/receive network through connecting lines; and a plurality of switches that are selectively actuatable to form the beam forming network;

wherein four quarter wavelength transmission lines are electrically coupled between the four 90-degree hybrids.

6. The switched beam forming network of claim 5, wherein the four guide quarter wavelength transmission lines are a first set of transmission lines, and wherein four of the plurality of switches and the first set of transmission lines are electrically coupled between a first pair of the 90-degree hybrids and the four input/output ports, and further comprising:

A second set of four transmission lines, each of the second set of four transmission lines having one end being electrically coupled to an input/output port of the first pair of the 90-degree hybrids, each of the second set of four transmission lines having another end electrically electrically coupled to each other to form a first common junction; and a bypass switch is electrically coupled to said first common junction and to a second common junction of the first of the input/output ports through a bypass transmission line;

the four of the plurality of switches and the bypass switch are configured to be selectively actuatable between an 'on' position and an 'off' position; and wherein the four of the plurality of switches are selectively actuated to the 'on' position and the bypass switch is selectively actuated to the 'off' position to provide the directional antenna radiation pattern; and wherein the four of the plurality of switches are selectively actuated to the 'off' position and the bypass switch is selectively actuated to the 'on' position to provide the omnidirectional antenna radiation pattern.

7. The switched beam forming network of claim 6, wherein the bypass switch is a single-pole, single-throw switch.

8. The switched beam forming network of claim 6, wherein at least one of the four of the plurality of switches is a single-pole, single-throw switch.

9. The switched beam forming network of claim 6, wherein each of said first transmission lines, said additional transmission lines, and said bypass transmission line have an electrical length equal to a quarter guide wavelength.

10. The switched beam forming network of claim 1 wherein the 90-degree hybrids are realized using 3 dB 90-degree two-branch directional couplers.

11. The switched beam forming network of claim 1 wherein the 90-degree hybrids are realized using 3 dB 90-degree coupled-line directional couplers.

12. The switched beam forming network of claim 1 wherein the antenna monopoles include a fifth antenna monopole, and wherein a fifth antenna terminal associated with the fifth antenna monopole is electrically coupled to a common junction of a first one of the input/output ports through the transmission lines and one of the plurality of switches, to thereby provide the omnidirectional antenna radiation pattern using the fifth antenna monopole.

13. A switched beam forming network comprising an antenna array and an integral beam forming network configured to selectively provide directional and omnidirectional antenna radiation patterns, wherein said integral beam forming network further includes:

four 90-degree hybrids being serially interconnected to form a 4×4 hybrid matrix, the hybrid matrix being operable to receive and transmit signals through antenna monopoles and configured to selectively switch between directional and omnidirectional operation;

at least four antenna terminals that connect the hybrid matrix to the antenna monopoles;

four input/output ports configured to connect the hybrid matrix to a transmit/receive network through connecting lines;

a plurality of switches that are selectively actuatable to form the beam forming network;

four quarter wavelength transmission lines electrically coupled between the four 90-degree hybrids;

wherein a 180-degree phase shifter is electrically coupled between an input/output port associated with one of the 90-degree hybrids and a first one of the antenna terminals;

wherein the 180-degree phase shifter, switched on a first 180-degree phase position, provides a progressive 90-degree phase shift for the four antenna terminals and creates an omnidirectional antenna radiation pattern with activation of only one of the input/output ports; and wherein the 180-degree phase shifter, switched on a second bypass position, creates a directional antenna radiation pattern with alternate activation of the four input/output ports.

14. The switched beam forming network of claim 13, wherein the 180-degree phase shifter is a switched-line 180-degree phase shifter.

15. The switched beam forming network of claim 13, wherein the antenna monopoles include a fifth antenna monopole, and wherein a fifth antenna terminal associated with the fifth antenna monopole is electrically coupled to a common junction of a first one of the input/output ports through the transmission line and one of the plurality of switches, to thereby provide the omnidirectional antenna radiation pattern using the fifth antenna monopole.

16. The switched beam forming network of claim 15, wherein the four quarter length transmission lines are a first set of transmission lines, and wherein four of the plurality of switches and the first set of transmission lines are electrically coupled between a first pair of the 90-degree hybrids and the four input/output ports, and further comprising:

A second set of four transmission lines, each of the second set of four transmission lines having one end being electrically coupled to an input/output port of the first pair of the 90-degree hybrids, each of the second set of four transmission lines having another end electrically electrically coupled to each other to form a first common junction; and a bypass switch is electrically coupled to said first common junction and to a second common junction of the first of the input/output ports through a bypass transmission line;

the four of the plurality of switches and the bypass switch are configured to be selectively actuatable between an 'on' position and an 'off' position; and wherein the four of the plurality of switches are selectively actuated to the 'on' position and the bypass switch is selectively actuated to the 'off' position to provide the directional antenna radiation pattern; and wherein the four of the plurality of switches are selectively actuated to the 'off' position and the bypass switch is selectively actuated to the 'on' position to provide the omnidirectional antenna radiation pattern.

17. The switched beam forming network of claim 5 wherein the 90-degree hybrids are realized using 3 dB 90-degree two-branch directional couplers.

18. The switched beam forming network of claim 5 wherein the 90-degree hybrids are realized using 3 dB 90-degree coupled-line directional couplers.

19. The switched beam forming network of claim 5 wherein the antenna monopoles include a fifth antenna monopole, and wherein a fifth antenna terminal associated with the fifth antenna monopole is electrically coupled to a common junction of a first one of the input/output ports through the transmission lines and one of the plurality of switches, to thereby provide the omnidirectional antenna radiation pattern using the fifth antenna monopole.

* * * * *